US010988270B2

(12) United States Patent
Gorbatenko et al.

(10) Patent No.: US 10,988,270 B2
(45) Date of Patent: Apr. 27, 2021

(54) PACKAGING APPARATUS AND SYSTEM TO FILL SINGLE-SERVE PODS

(71) Applicant: Gorby LLC, St. Paul, MN (US)

(72) Inventors: George Gorbatenko, St. Paul, MN (US); Charles Roth, Hudson, WI (US); Chris Zwettler, Stillwater, MN (US)

(73) Assignee: GORBY LLC, Saint Paul, MN (US)

( * ) Notice: Subject to any disclaimer, the term of this patent is extended or adjusted under 35 U.S.C. 154(b) by 200 days.

(21) Appl. No.: 16/181,536

(22) Filed: Nov. 6, 2018

(65) Prior Publication Data

US 2019/0135466 A1 May 9, 2019

Related U.S. Application Data

(60) Provisional application No. 62/581,882, filed on Nov. 6, 2017.

(51) Int. Cl.

| | |
|---|---|
| ***B65B 29/06*** | (2006.01) |
| ***B65B 29/02*** | (2006.01) |
| ***B65B 57/02*** | (2006.01) |
| ***B65B 51/10*** | (2006.01) |
| ***B65B 43/50*** | (2006.01) |
| ***B65B 51/14*** | (2006.01) |

(52) U.S. Cl.

CPC ..... *B65B 29/022* (2017.08); *B65B 43/50* (2013.01); *B65B 51/10* (2013.01); *B65B 51/14* (2013.01); *B65B 57/02* (2013.01)

(58) Field of Classification Search

CPC ..... B65B 29/022; B65B 29/025; B65B 1/10; B65B 1/12; B65B 7/2878; B65B 29/02; B65B 37/10; B65B 43/50; B65B 43/54; B65B 43/60

USPC ..... 53/55, 67, 281, 329.2, 329.5, 471, 478

See application file for complete search history.

(56) References Cited

U.S. PATENT DOCUMENTS

| | | | | |
|---|---|---|---|---|
| 3,579,350 | A * | 5/1971 | Rudd | B65D 85/8046 426/79 |
| 4,024,694 | A * | 5/1977 | Cooper | B65B 1/02 53/282 |
| 5,301,488 | A * | 4/1994 | Ruhl | B67C 7/00 53/282 |
| 5,325,765 | A | 7/1994 | Sylvan et al. | |
| 5,840,189 | A | 11/1998 | Sylvan et al. | |
| 8,276,639 | B2 * | 10/2012 | Binacchi | B65B 61/20 156/566 |
| 8,875,477 | B2 | 11/2014 | Rivera | |

(Continued)

FOREIGN PATENT DOCUMENTS

| | | | | |
|---|---|---|---|---|
| EP | 3141486 | A1 * | 3/2017 | B65B 7/164 |
| FR | 3040979 | B1 | 10/2017 | |

*Primary Examiner* — Andrew M Tecco
*Assistant Examiner* — Eyamindae C Jallow
(74) *Attorney, Agent, or Firm* — Kagan Binder, PLLC

(57) ABSTRACT

An apparatus and packaging system for filling single-serve pods is described. The apparatus includes a base for supporting a rotatable platform comprising multiple pod holders, a filler mounted on the base and adjacent to the rotatable platform comprising a container filled with food product and multiple augers capable of filling the pods with food product, a sealer mounted on the base comprising a film winder, and a controller directing rotation of the rotatable platform, filling of the food product from the filler, and sealing and trimming of the sealed film tops of the single-serve pods.

13 Claims, 13 Drawing Sheets

(56) References Cited

U.S. PATENT DOCUMENTS

| | | | | |
|---|---|---|---|---|
| 9,271,602 | B2 | 3/2016 | Beaulieu et al. | |
| 9,963,256 | B2 | 5/2018 | Hansen et al. | |
| 2008/0299262 | A1* | 12/2008 | Reati | B65D 85/8043 426/84 |
| 2010/0047419 | A1 | 2/2010 | Boul | |
| 2011/0303095 | A1 | 12/2011 | Fu et al. | |
| 2012/0207895 | A1 | 8/2012 | Rivera | |
| 2012/0279178 | A1* | 11/2012 | Griscik | B65B 29/00 53/431 |
| 2013/0125508 | A1* | 5/2013 | Honda | B65B 43/50 53/268 |
| 2015/0158609 | A1* | 6/2015 | Villain | B65B 29/022 426/112 |
| 2015/0307267 | A1 | 10/2015 | Jackson | |
| 2016/0009429 | A1 | 1/2016 | Mahoney et al. | |
| 2017/0210553 | A1* | 7/2017 | Burress | B65B 7/28 |
| 2017/0283101 | A1 | 10/2017 | Gorbatenko | |
| 2018/0279822 | A1* | 10/2018 | Bertash | B65B 29/022 |

* cited by examiner

40

BASIC COMPONENTS OF A PRESS & SEAL OPERATION

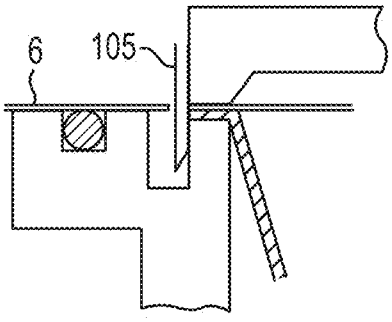
(a) TRIM CUT; FILM HELD IN PLACE BY O RING (9)
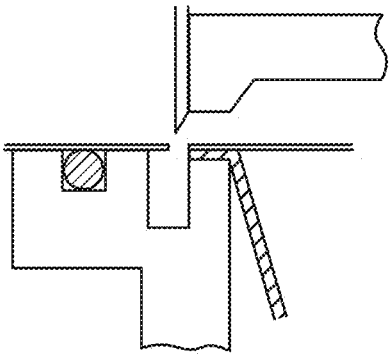
(b) TRIM COMPLETE; PLATEN STARTS UPWARD MOTION. O RING BEGINS TO RELEASE FILM.
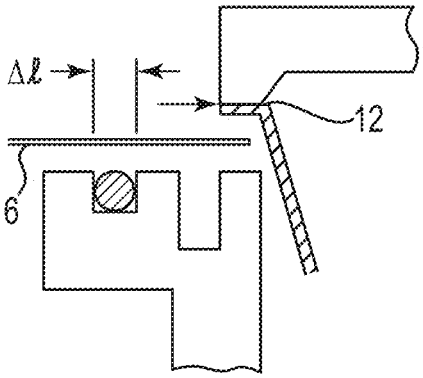
(c) CUP IS HELD TO PLATEN DUE TO STICKY SURFACE (12). FILM (b) IS UNDER TENSION & WEDGES BENEATH LIP.
PRESS & SEAL DETAIL.
FIG. 9

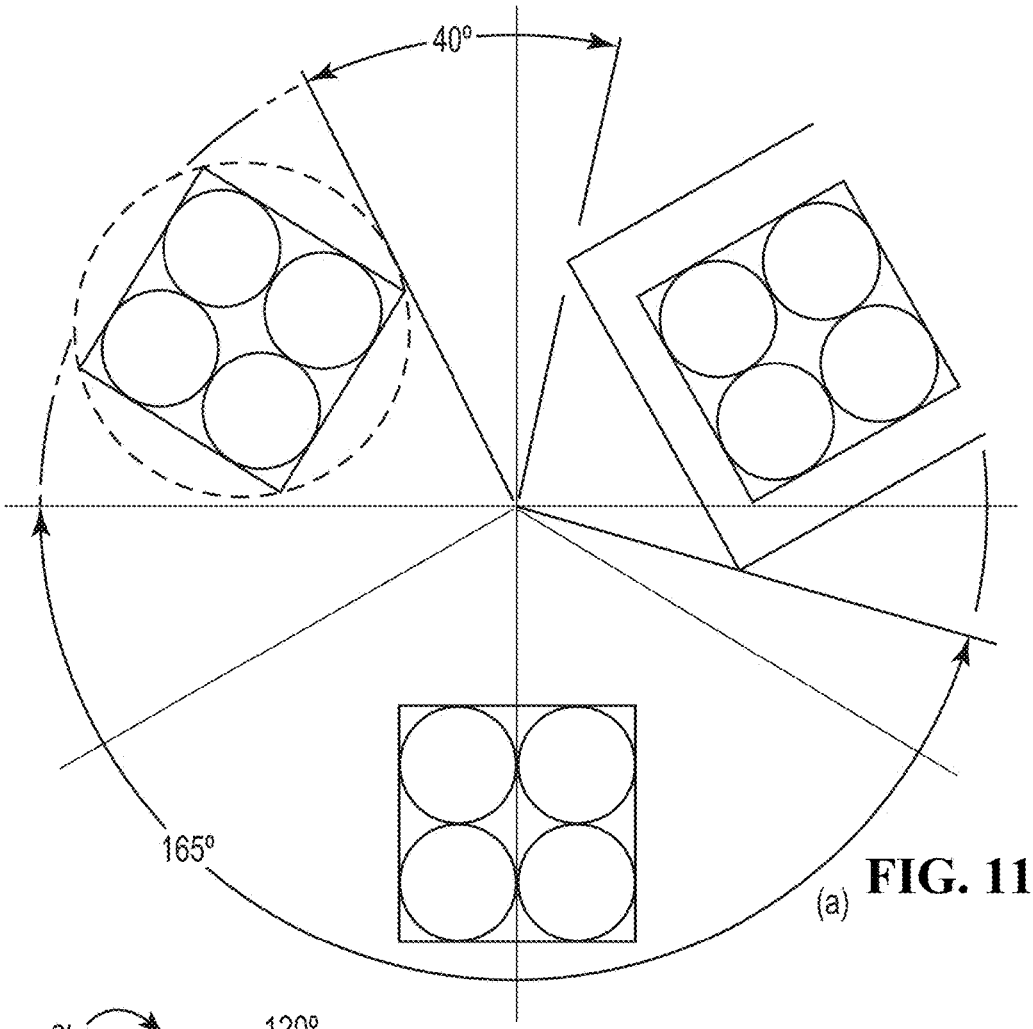
(a) FIG. 11a
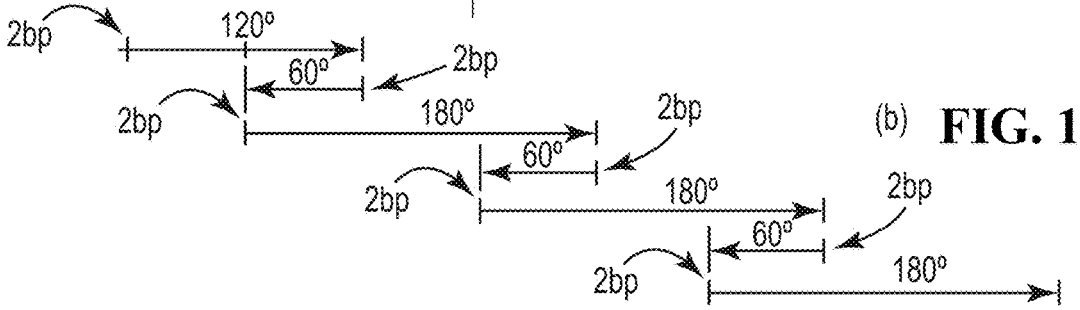
(b) FIG. 11b
(a) LAYOUT OF TABLE SHOWING CONSTRICTED ACCESS
(b) DIRECTIONAL FLOW IN TWO-STEP MODE. TWO BUTTON PRESS (2BP) REQUIRED FOR EACH SEGMENT

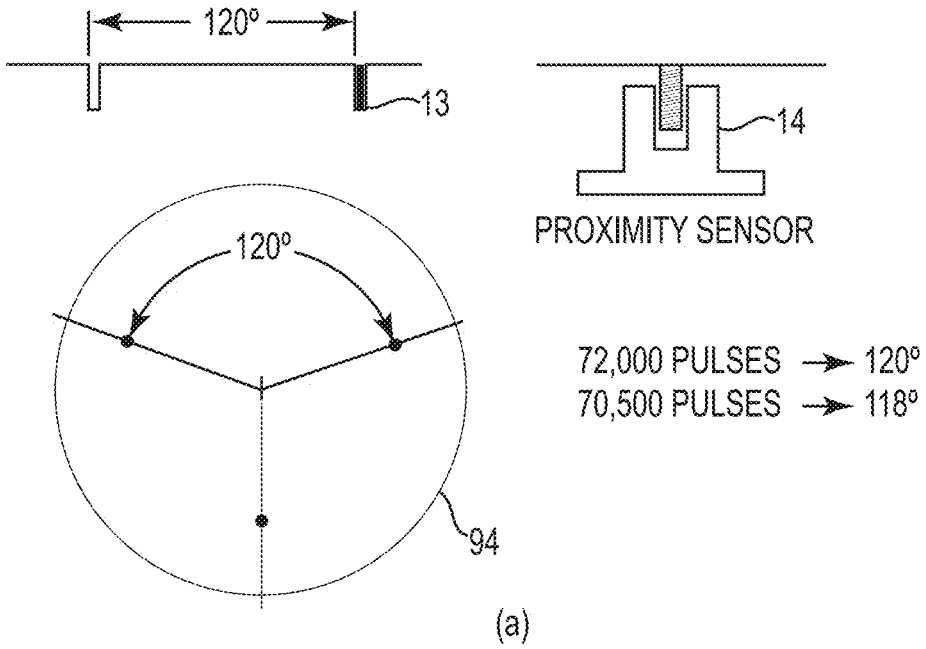
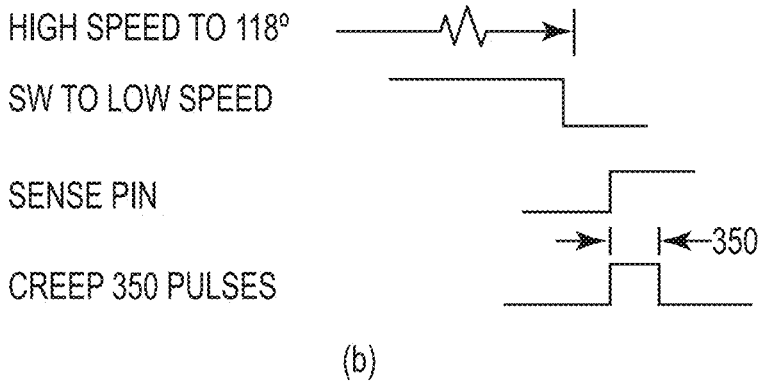
PRECISION OPEN LOOP TABLE CONTROL USING INDEX PINS
FIG. 12

PACKAGING APPARATUS AND SYSTEM TO FILL SINGLE-SERVE PODS

PRIORITY CLAIM

This application claims the benefit of U.S. Provisional Application Ser. No. 62/581,882, filed Nov. 6, 2017, entitled "PACKAGING APPARATUS AND SYSTEM TO FILL SINGLE-SERVE PODS", which is herein incorporated by reference in its entirety.

FIELD OF THE INVENTION

Embodiments of the invention relate to a device and method for filling single-serve beverage containers.

BACKGROUND

Single serve brewing devices and methods have become popular recently, as consumers desire a hot beverage on demand without any effort.

Many factors contribute to an optimum quality of a hot beverage, for example a brewed beverage. Brewed coffee may be influenced by the bean, roast, water, grind, ratio of coffee to water, brew time, and temperature of the water. The relationship between grind and the amount of coffee is important. A finer grind extracts more flavors from the coffee, but can easily become bitter. In contrast, a coarser grind produces a smoother flavor, but requires more coffee to achieve the same flavor. Unfortunately, single serve coffee pods do not allow the user to increase the amount of coffee contained in the pods. There is evidence among specialty coffee roasters that the subtle flavors associated with quality coffee rapidly degrade with time, perhaps hours after roasting. To capture those flavors requires on-site packaging.

SUMMARY

Disclosed are improvements to an apparatus and packaging system that provides packaged food product (e.g. coffee) in small pods. A suitable apparatus and packaging system is described, for example, in U.S. Patent Application Publication Number 2017-0283101-A1, incorporated by reference in this disclosure in its entirety. In some embodiments the pods are made from materials that are certified 100% compostable. In one embodiment of the present disclosure is an apparatus and packaging system for filling single-serve pods, comprising a base supporting a rotatable platform comprising pod holders located at three stations displaced equidistant in 120° sectors around the rotatable top;

a filler mounted on the base and adjacent to the rotatable platform comprising a container filled with a ground food product and multiple augers capable of filling the pods with a ground food product, wherein the multiple augers having multiple spouts to deliver the ground food product to the pods;

a sealer mounted on the base and adjacent to the rotatable platform comprising film winder, a movable heater block assembly fitted with an accurate linear actuator and a trimmer, wherein the heater block assembly is aligned with a top of the pods to apply and seal the heat sealable film to a top of the pods, and wherein the trimmer cuts the heat sealable film sealed to the pods, and a controller directing rotation of the rotatable platform, filling of the ground food product from the filler, and sealing and trimming of the sealed film tops of the single-serve, pods. In an embodiment, the pod holders are capable of holding four pods at a single time. The pods may comprise a filter located at a bottom of the pods. The pods may be capable of withstanding temperature up to 325° F. The pods may be compostable, for example, made from polylactic acid. In an embodiment, the pods may further comprise 2% $TiO_2$, 1% IM, (BIOMAX Strong 129), and 2% Nucleant ((CN-L03 (EBS)).

The apparatus is capable of filling pods with a food product, the food product may be coffee, tea, hot chocolate, and powdered milk, or other similar food product.

In another embodiment, the apparatus may further comprise an actuator to remove the pods after being filled with the food product. In one embodiment, for example, filled pods are suitably pushed-up from the pod holders and a solenoid-controlled sweep arm may be used to sweep the filled pods from the pod holders of the rotatable platform. In another embodiment, a suitable automated pod filler system may be used to fill the empty pod holders with empty pods after the filled pods have been removed from the pod holders.

In one embodiment of the present disclosure is a method for filing a single-use pod, the method comprising:

rotating a platform from a load station to a filling station, the platform comprising multiple pod holders located at three stations displaced equidistant in 120° sectors around the platform;

filling an empty pod with a ground food product from multiple augers and multiple spouts that are adapted to deliver the ground food product into the empty pods;

rotating the filled pods from the filling station, to a sealing and trimming station; and sealing the filled pods with a heat sealable film by applying and sealing the heat sealable film by applying both heat and pressure to attached the film to the filled pods, and then a trimmer cuts the sealed film;

wherein the rotating, filing and sealing steps are controlled by a controller comprising software controlling and directing movement and operations of the platform, the filler, and the trimmer.

In another embodiment of the present disclosure is a system for filling single-use, pods, the system comprising:

a controllable, rotatable platform comprising multiple pod holders located at three stations displaced equidistant in 120° sectors around the rotatable top adapted to move empty pods from a load station on the platform, to a filling station, and then to a sealing and trimming station;

a controllable filler comprising a container filled with a ground food product and multiple augers and multiple spouts that are adapted to deliver the ground food product into the pods, wherein the multiple augers and multiple spouts adapted to fill the ground food product to the empty pods;

a controllable sealer and trimmer comprising a film winder, a movable heater block assembly fitted with an accurate linear actuator, and a trimmer, wherein the heater block assembly is aligned with a top of the pods to apply and seal the heat sealable film to filled pods, and wherein the trimmer cuts the heat sealable film sealed to the pods; and a controller comprising software controlling and directing movement and operations of the rotatable platform, the filler and the trimmer to fill single serve, pods with the ground food product, and heat seal a film top to the filled pods.

BRIEF DESCRIPTION OF THE DRAWINGS

FIG. 9 illustrates an embodiment of the seal process.

FIG. 11*a* illustrates an embodiment of the turntable.

FIG. 11*b* illustrates schematically an embodiment of the pattern of the turntable in a 2-step mode.

FIG. 12 illustrates an embodiment of the underside of the turntable.

DETAILED DESCRIPTION

Figure 1:
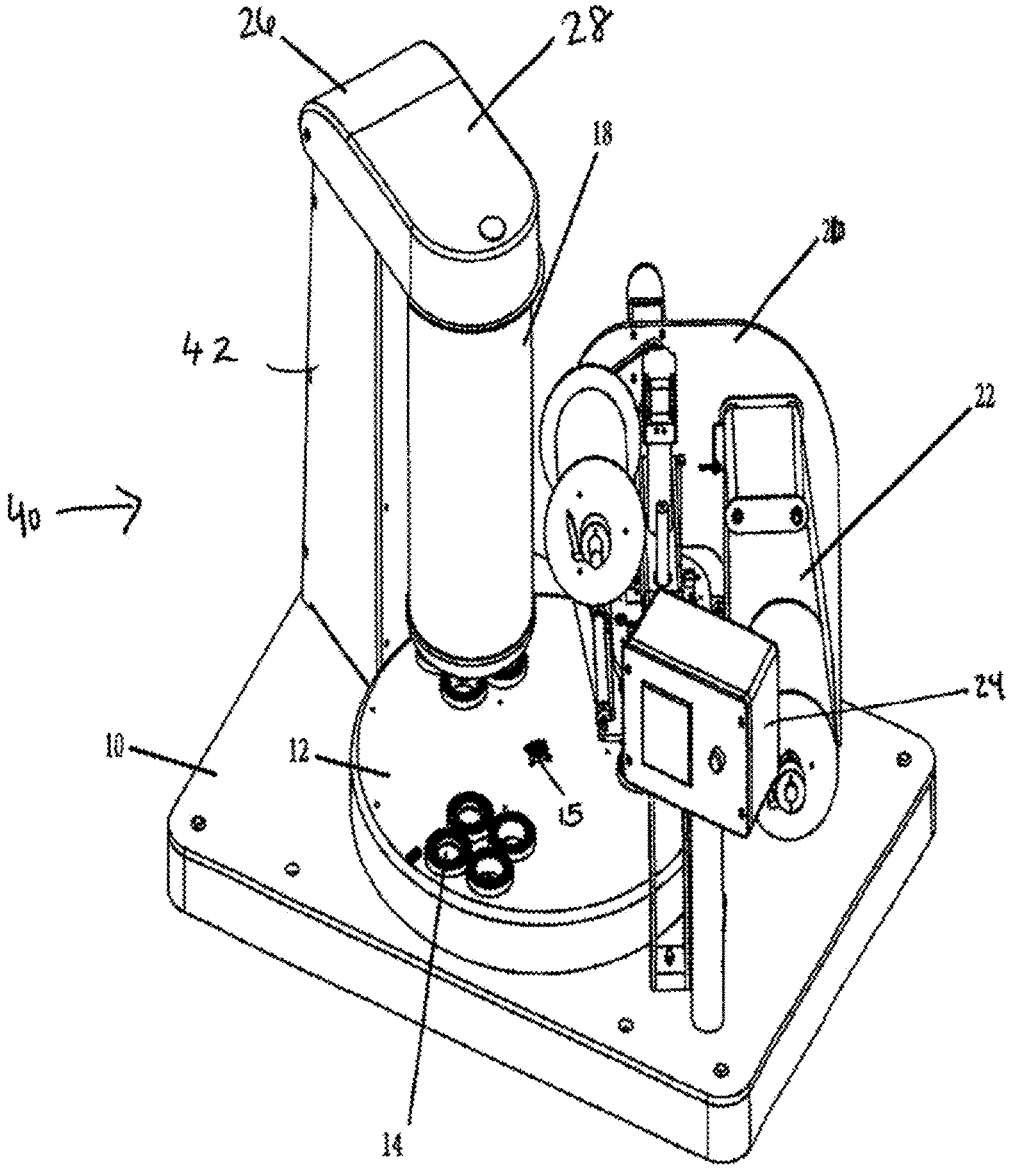
FIGS. 1-3 illustrate an example embodiment of an apparatus and packaging system for filling pods.
Figure 2:
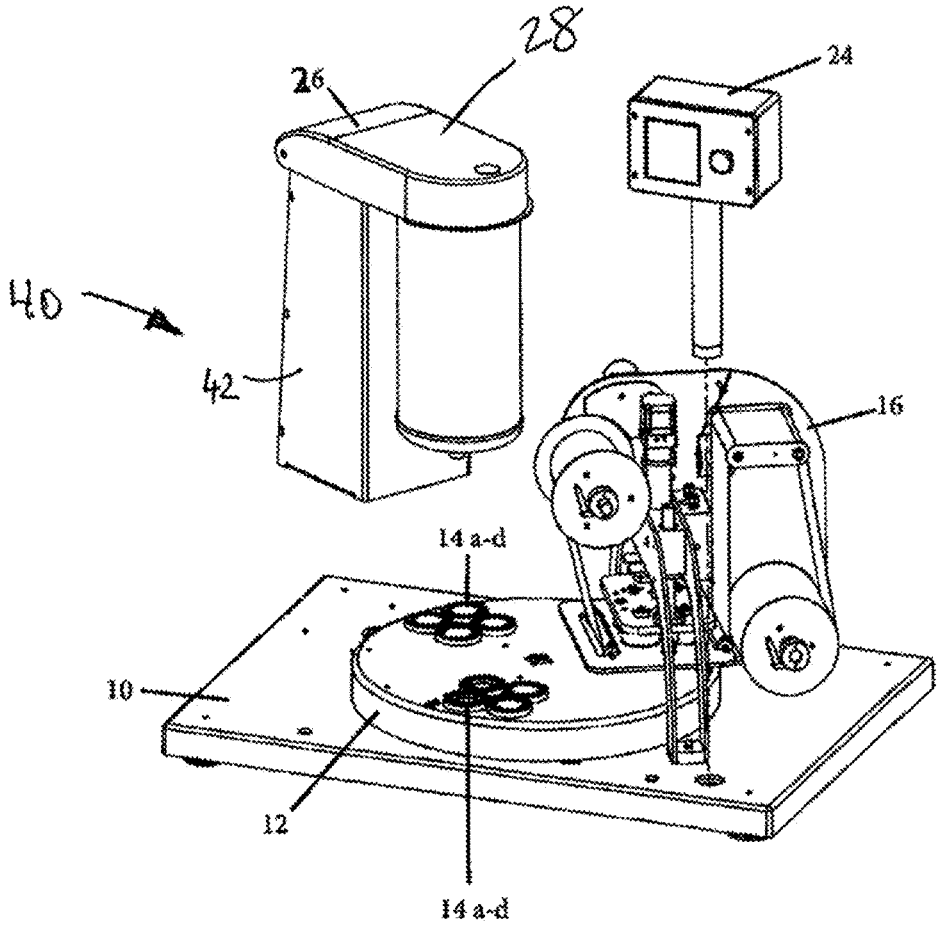
Figure 3:
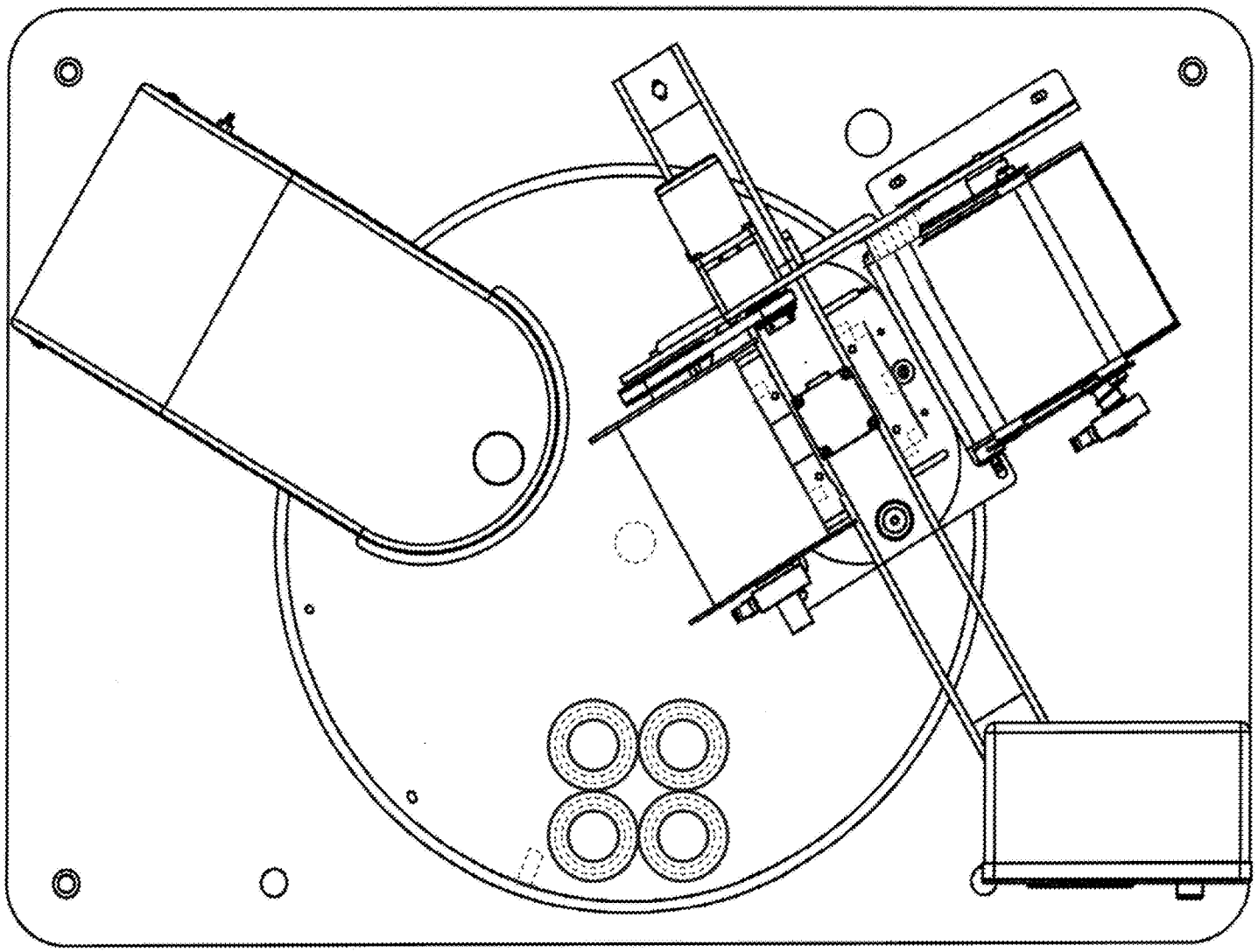

While the disclosed subject matter is amenable to various modifications and alternative forms, specific embodiments have been shown by way of example in the drawings and are described in details below. The intention; however, is not to limit the disclosure to the particular embodiments described. On the contrary, the disclosure is intended to cover all modifications, equivalents, and alternatives falling within the scope of the disclosure as defined by the appended claims.

Disclosed are improvements to an apparatus and packaging system that provides packaged ground coffee and other food products in small pods made from materials that are 100% compostable. Geared to the smaller specialty coffee roaster, the apparatus is affordable, compact, reliable and able to function in a wide range of settings.

The major components of the disclosed apparatus and system are the pods, the filler, seal and trimmer, lid film transport, turntable, and computer control. Details of the apparatus and system are described in U.S. Provisional Application Ser. No. 62/315,888 filed Mar. 31, 2016 and U.S. patent application Ser. No. 15/428,788 filed Feb. 9, 2017, each document incorporated herein by reference in their entirety.

To understand the improvements to the apparatus and packaging system, reference is made to FIGS. 1-5. FIGS. 1-5 illustrate a packaging system 40 for filling single-serve pods 30. The packaging system 40 includes base 10 for supporting rotatable platform 12 having multiple pod holders 14, auger assembly 26 having container 18 and cover 28 filled with a food product and multiple augers (not shown) capable of filling the pods 30, which are housed within pod holder 14, with the food product, seal and trim station 20 mounted on the base 10 comprising a film winder 22, and a controller 24 directing rotation of the rotatable platform 12, filling of the food product from the auger assembly 26, and sealing and trimming of the sealed film tops of the single-serve pods 30. In one embodiment, the pods are compostable.

In one embodiment, a filling cylinder 18 is attached to a mounting tower 42 on the base 10. Four gear driven augers (not shown) are positioned above the multiple pod holders 14 to feed the food product into the pods 30. The capacity of the enclosed cylinder 18 is about 5-7 pounds of food product. Agitators (not shown) are mounted on the auger shaft to insure even distribution of food product in each of the pods 30.

Figure 4A:
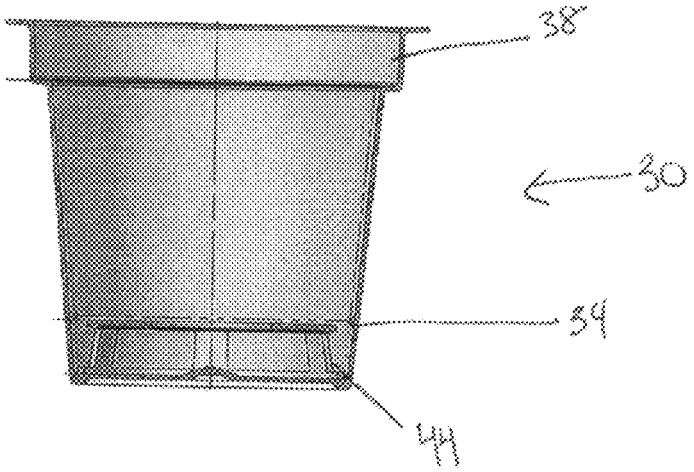
FIGS. 4*a* and 4*b* illustrate an embodiment of a single-serve pod.
Figure 4B:
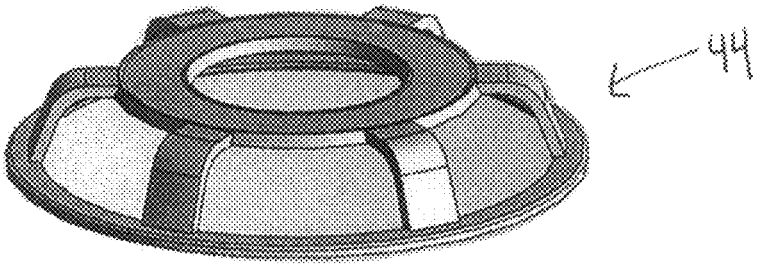

The amount of food product filled is based on time. By varying the time that the augers rotate, more or less food product can be delivered into the pods 30. Pod 30 as illustrated in FIG. 4*a* is mounted within pod holders 14. The filling cylinder 18 is easily removed from mounting tower 42 and replaced by a second filling cylinder, thereby accommodating different food product. Once removed, a single screw allows for easy disassembly for washing or sanitizing. Once the pods 30 are filled, they proceed to seal and trim station 20.

The rotatable platform 12 is the means by which pods 30 are transported from load/unload, to fill, to seal and trimmer, and back to load/unload. The 2×2 pod matrix is accurately defined by the precision placement of pod holders 14. Bushings to accept the aforementioned tapered pins (not shown) are accurately positioned on 120° sector boundaries in alignment with the three stations of the packaging system 40. Beneath the rotatable platform 12 are three pins that are mounted to correspond to the 120° sectors. Those pins interrupt a light beam which provides an independent reference for the turntable's stepper motor. In embodiments, the pins are in association or connection with the controller, which together can aid in correcting the position of the platform 12, if needed.

There are also two holes in the rotatable platform 12 that allow an in-field calibration means of positioning the supporting arch so that it is properly aligned to the pod holders 14. Existing tapered pins in the stripper plate are used for that purpose.

To remove the rotatable platform 12, the container 18 must be removed first. The sealing and trim station 20 must be raised above the rotatable platform 12. By unscrewing a hub screw, the rotatable platform 12 is free to be removed from the base 10 by lifting up and then carefully pulling out. When reinstalling the rotatable platform 12, the rotatable platform 12 should be rotated so that the pod holders 14 are not in line with the sealing axis. Failure to do this will likely damage the 120° defining sector pins.

The rotatable platform 12 is spun from aluminum to produce a sturdy three-dimensional structure. The turn-down lip provides the strength while hiding operations beneath the rotatable platform 12. Operations include a geared motor (drives rotatable platform 12), a sector sensor (defines the sectors), and pod sensor (senses empty or misaligned pods 30).

All key features are based off the rotatable platform center 15 a reference that is used to fabricate the rotatable platform 12 and thus inherently accurate. Precision bushings are installed at sector intervals to ensure perfect rotational alignment.

Once the pods 30 are sealed, they are rotated to the final station where they are pushed up from underneath by a ramp for easy withdrawal from the pod holders by an operator. Alternatively, the filled, sealed pods could be projected upward and out of the holder using a controlled push pin or push bar and the ejected pods could then be swept from the pod holders using a controlled arm or bar the removes the filled sealed pods from the pod holders and rotatable platform in order for the system to begin another filling cycle.

The packaging system 40 also includes a controller 24. A programmable logic controller (PLC) accepts inputs from the various sensors, processes them, and then sends signals to the various motion control systems. A touch screen accepts operator input and allows all the input parameters to be set. In addition, the system allows subsystems to be exercised and validate I/O signals.

Figure 5A:
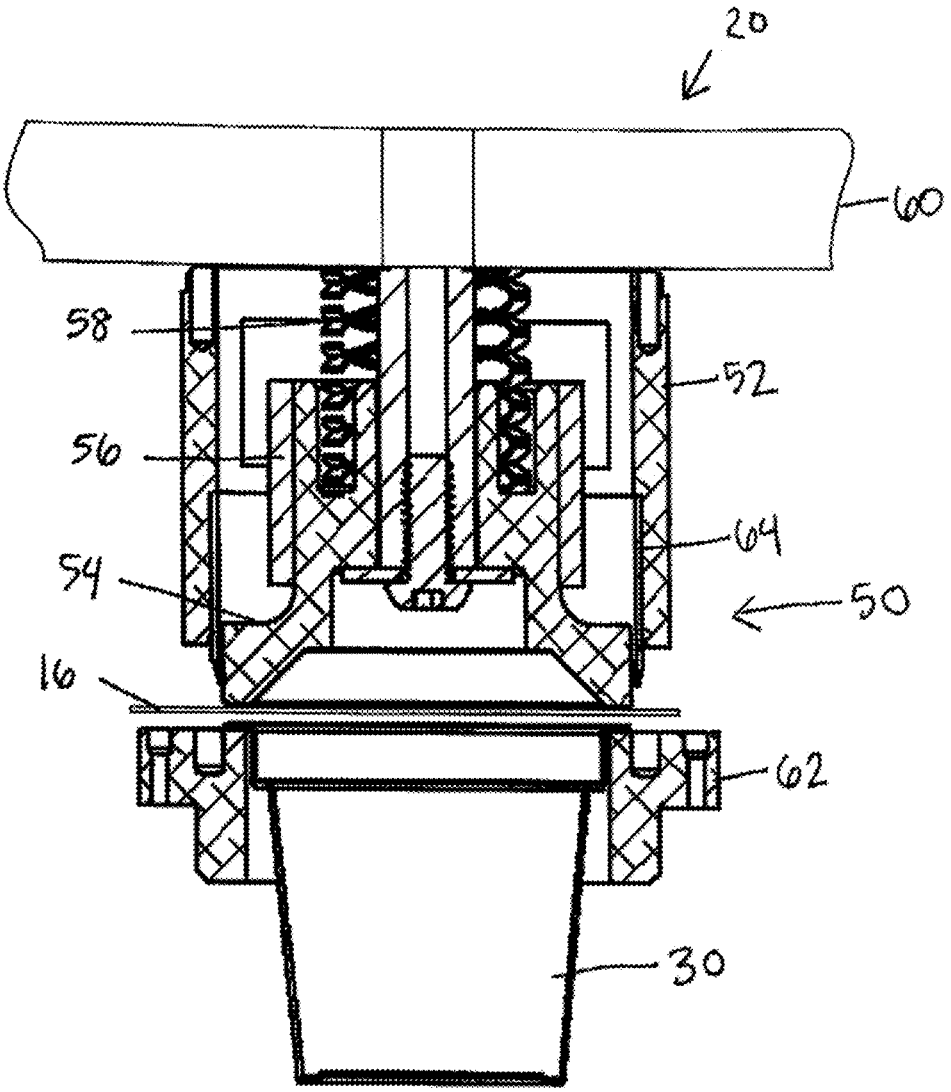
FIGS. 5*a* and 5*b* illustrate multiple views of an embodiment of a seal and trimmer component of the apparatus and packaging system.

The sealing and trim station 20 is shown in more detail at FIG. 5*a*. The sealing and trim station 20 consists of a vertically moving assembly 50 and a rotatable pod holder 62. The rotatable pod holder 62 is part of the pod holder assembly 14. The vertically moving assembly 50 and rotatable pod holder 62 are aligned with a tapered pin (not shown) on the assembly and a corresponding bushing on the base 10. The vertically moving assembly 50 comprises a trim cylinder 52 which contains a steel rule cutting die 64, a heated sealer shoe 54 with a Teflon® coating and a wrap-around heater 56. A coiled spring provides a uniform sealing force 58. This is held together in a concentric configuration by a heater block 60.

Figure 5B:
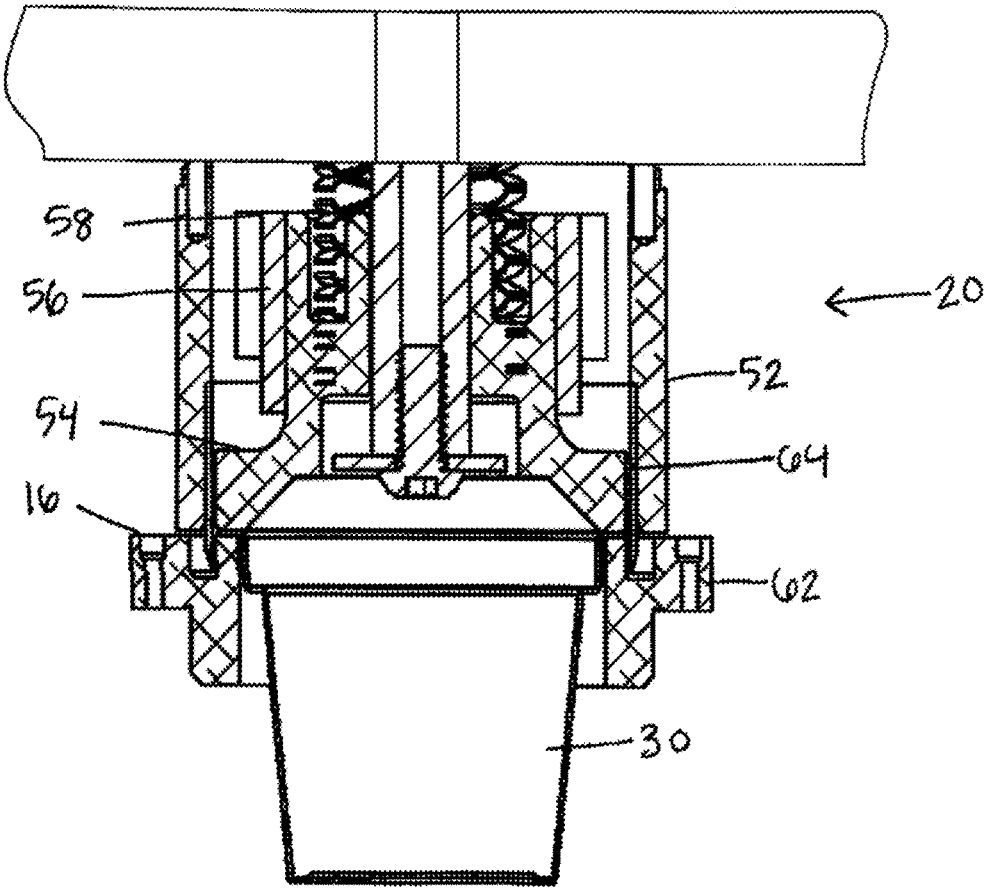

The sealing and trim station 20 is located above the rotatable platform 12, which allows the rotatable platform 12 to rotate freely below. In use, the sealer shoe 54 moves downward to press film 16 across the pods 30. FIG. 5*b* illustrates the sealer shoe 54 when pressing film 16 on pods 30.

The sealer shoe 54 slides on a bearing shaft (not shown) that is fastened to the heater block 60 and heated by wrap-around heaters with controlled temperatures ranging from 200-350° F. Integrated spring provides necessary sealing force. A programmable logic controller (PLC) senses temperature and controls heaters accordingly.

A heater block 60 is vertically driven by a linear actuator (not shown), which accurately positions the concentric sealing and trim station 20. Bearing shafts are spindled through the heater block 60.

An actuator is driven by stepper motor and accurately positions the heater block 60. The force is evenly divided among the seal and trim station 20 that comprise a 2×2 matrix of pod holders 62 in the seal and trim station 20. As the heated sealer shoe 54 hits the pod lip 38 (in the course of the seal), the pods 30 are forced flat against the pod holder 62 in the seal and trim station 20.

Bearings assure that the various parts remain in alignment. Two large bearing shafts (not shown) are on either side of the actuator. In addition, each heater block 60 rides in a smaller shaft bearing.

To assure that tension is maintained in the course of these operations, a tensioner (not shown) is employed. By adjusting the slip on the source reel, the tensioner can be set to midrange where correct tension is maintained.

An accurate linear actuator (not shown) is positioned directly above and centered on the heater block 60. Bearing shafts on either side insure that all the critical elements are in line and move freely. For maintenance, the heater block 60 can be raised for easier access to the components.

A skid plate is tied to heater block 60 through bearings, which holds film 16 in position. The skid plate (not shown) also contains the precision tapered pin. It provides rollers and adjustment to guide entry and exit of the top film.

The purpose of the film 16 is to support the graphic and seal the food product in the pods 30. The film 16 is principally comprised of two parts: a first part is printable and offers a barrier (e.g. 80 NKME, produced by INNOVIA) and a second part that is a backing layer designed to stick to the lip 38 of the pods 30. A PLA film produced by BI-AX International Inc. not only trims well, but the PLA to PLA interface produces good seals at lower temperatures.

The packaging system 40 also includes a controller 24. The controller 24 directs and monitors four operations: Fill, Seal, Trim, and Load/Unload. To reduce the size of the overall device, the Seal and Trim may be combined into one operation, resulting in 3 stations.

To minimize the foot print, the three stations are apportioned to a turntable; each station allocated a 120° sector. To achieve adequate throughput, a four pod design is chosen. Thus, four pods 30 are being filled, while four are being sealed, while the finished pods 30 are replaced with empty pods 30.

A method of using the packaging system 40 includes having the pressure plate hold film 16 in position, using the heater block 60 to contact film 16 and starts the sealing process, and using the trim cylinder 52 to trim the now sealed pods 30. At the conclusion of trimming, the sequence is reversed. The trim follows the seal and then is the first to rise. By holding the film 16 by the heater block 60, extraction of the cutting die 64 is facilitated, resulting in a clean trim.

The units that make up the sealing and trim station 20 are held concentric by mounting to the heater block 60. By making the seal and trim operation integral, alignment is assured allowing for a professional look that mimics production machines that cost considerably more.

18 and the vertical wall of the fill tower is uniform, the assembly is in proper adjustment.

Gimballed Cup Holders in Turntable

The rotatable platform 12 is fabricated using a spun aluminum technique. While this provides a one piece design that is economical to produce, inherent in the process is the introduction of stress induced variations. Thus, in what otherwise would be a perfectly flat plate, the surface develops a waviness that compromises the pod's seal (see, for example, FIG. 6*b*).

The seal is achieved by mating a heated platen or heater block 60 (that is well fixed and plumb in nature) to a pod residing in a pod holder fixed to the rotatable platform 12. Because of the aforementioned rotatable platform 12 variances, there is no assurance that the mating surfaces of the pod and the heated platen are in the same plane, thereby compromising the seal.

The solution to the problem is achieved by allowing the pod holders to "float" in place. In embodiments, they are held by a snap ring that permits adequate vertical motion as well as twisting and turning in place. The lateral position is well defined by virtue of the rotatable platform 12. In effect, mounting of the pod is analogous to a gimbal arrangement. In operation the mating surfaces of the pod 30 and heater block 60 become coplanar resulting in a good seal.

Figure 7A:
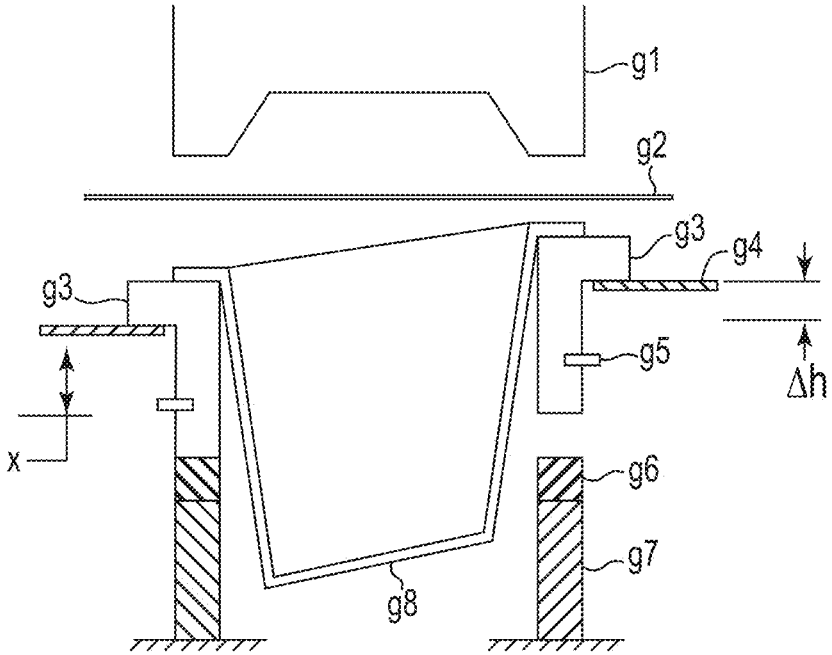
FIG. 7*a* illustrates a cross-section of a pod and a pod holder having an exaggerated canted pod caused by a deformed turntable surface.
Figure 7B:
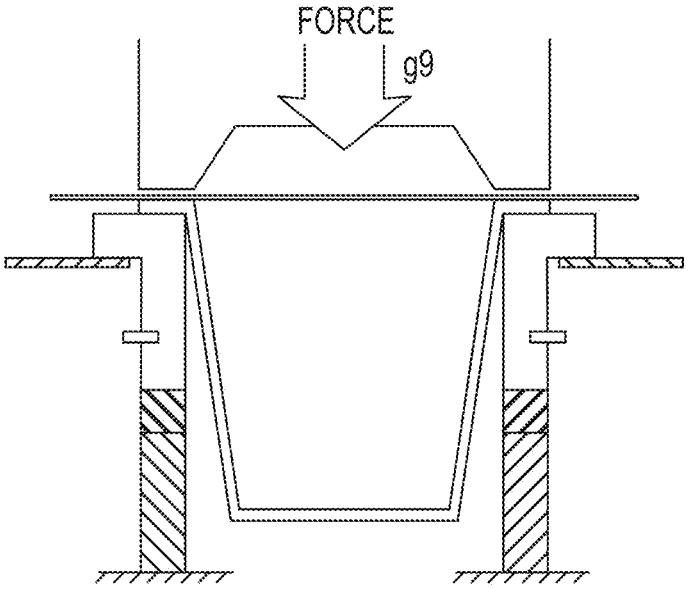
FIG. 7*b* is a cross section of the pod and pod holder as in FIG. 7*a* but with a corrected sealed pod.

In some embodiments, beneath the pod holder a layer of rubber is added to provide the necessary compliance between the heater block 60 and the pod holders (FIGS. 7*a* and 7*b*).

Figure 6A:
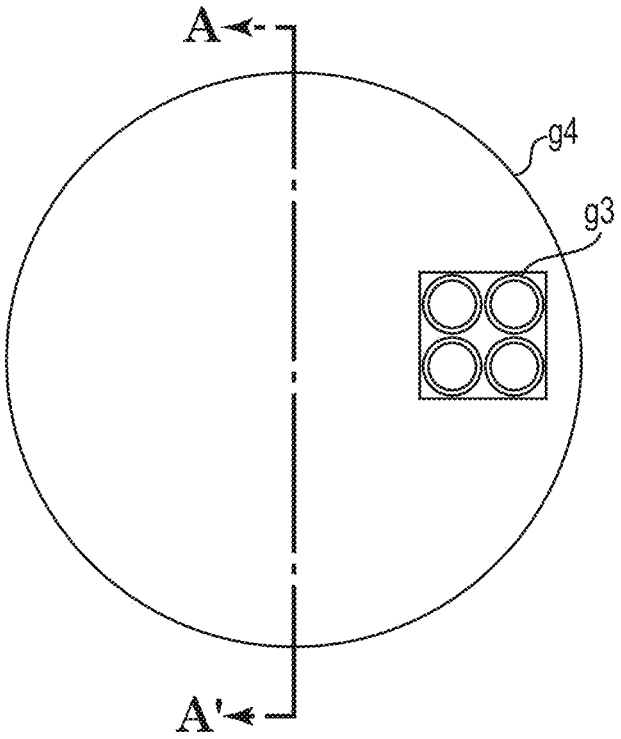
FIG. 6*a* is a top view having a section cut AA' that is a deformed turntable of an embodiment of the apparatus and packaging system.
Figure 6B:
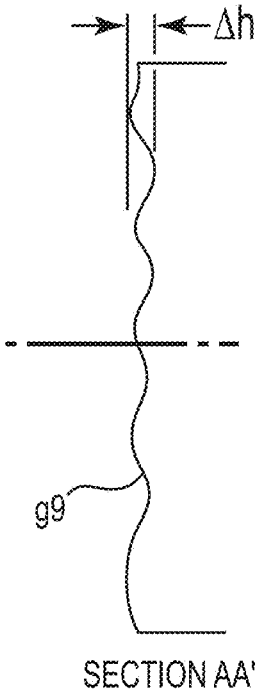
FIG. 6*b* is the AA' section cut of a turntable of an embodiment of the apparatus and packaging system as shown in FIG. 6*a*.

FIG. 6 shows a turntable made from spun aluminum g4 that holds one or more pod holders in the desired lateral position. In section AA' the waviness from manufacturing stress g9 is shown as the peak to valley distance referenced as Δh.

FIG. 7*a* shows a section view of the pod holder. Following the waviness of the rotatable turntable, the pod holder is canted Δh. The pod holder is fixed laterally, but is free to move vertically in gimbal fashion, restrained by a snap ring g5.

A resilient member g6 is affixed to bearing support g7. Thus, a sandwich is made between the canted holder, resilient member, and bearing support.

The heater block g1 is positioned above g2, establishing a plane. Likewise the pod holder and the turntable define a plane. In general, the two planes are distinct (i.e., not in the same plane, not coplanar). FIG. 7*a* shows a misaligned pod. Misaligned pods can result in inconsistent or improperly sealed pods. The disclosed improvement of "floating" the pod holders allows the pod to be properly aligned for sealing as seen in FIG. 7*b*.

Timely Film Jog Avoids Jam

Figure 8:
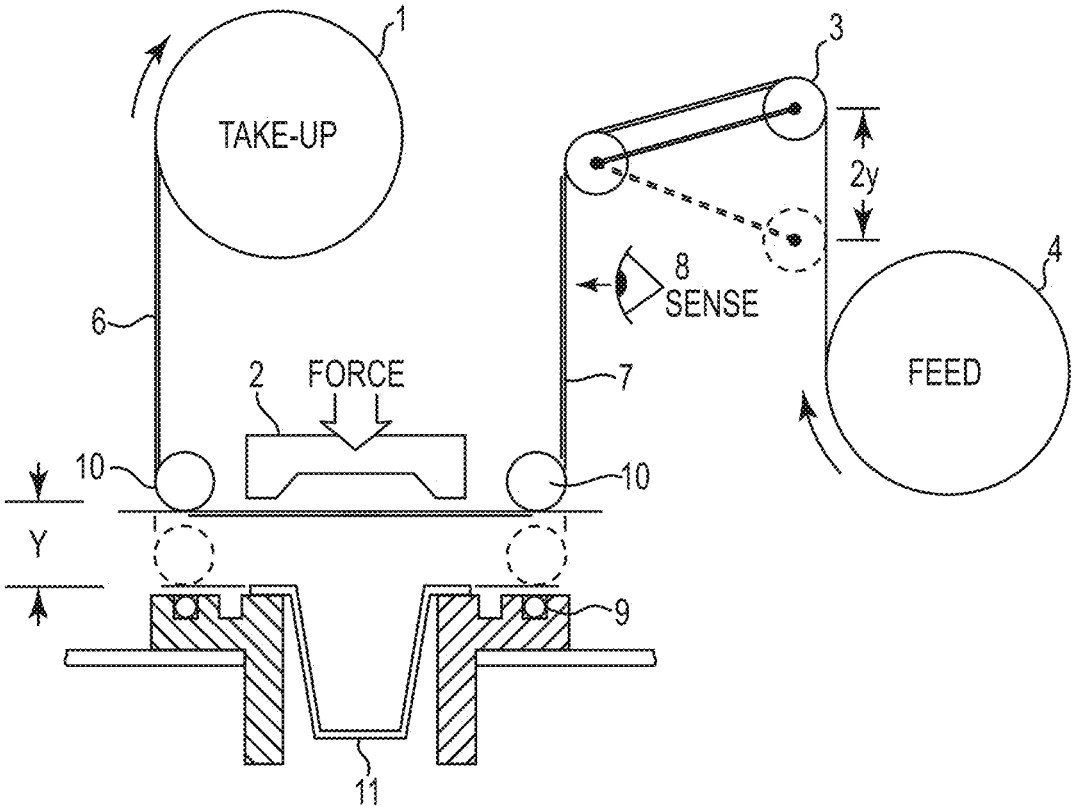
FIG. 8 illustrates an embodiment of the seal and trimmer component of the apparatus and packaging system.

FIG. 8 shows the major components of the seal mechanism consisting of a driven take-up spool (1), heater block (2) tensioner (3), and a source spool (4). While the pods are being transported by the rotatable turntable, the head is positioned "Y" above the sealing surface and clear of the moving pods. At the same time, the film, (comprised of a leading part (6) and a trailing part (7)) is threading through the mechanism in lock step.

Once the pods are in position and the take-up reel is stopped, the heater block is moved down a distance "Y" to achieve the seal as depicted by a dotted line. Since the leading film (6) is stopped, the extra length "2y" is provided by the trailing film (7) by means of the tensioner changing position.

FIG. 9*a* shows a blowup of the area of interest. Following the seal, the film is trimmed by a trim blade (10.5) that cuts the sealed film. FIG. 9*b* shows when the operation is reversed where the cup remains in place as the heater block proceeds on its upward path.

FIG. 9*c*, shows the pod being drawn upward slightly by the heater block due to a sticky surface. At the same time the film no longer retained by the rubber is free to move and starts to move backward a distance of "2y". Once the film is beneath the lip, it can jam and result in failure.

The solution to the problem, in an embodiment is to pulse the take up motor. Once the film is free to move and starts its backward traversal, the take up motor is jogged forward thereby temporarily cancelling the backward motion rendering the film static during the critical time. Since the speed of the heater block is known as well as the distance "Y", a reasonable cancellation can be achieved.

Figure 10:
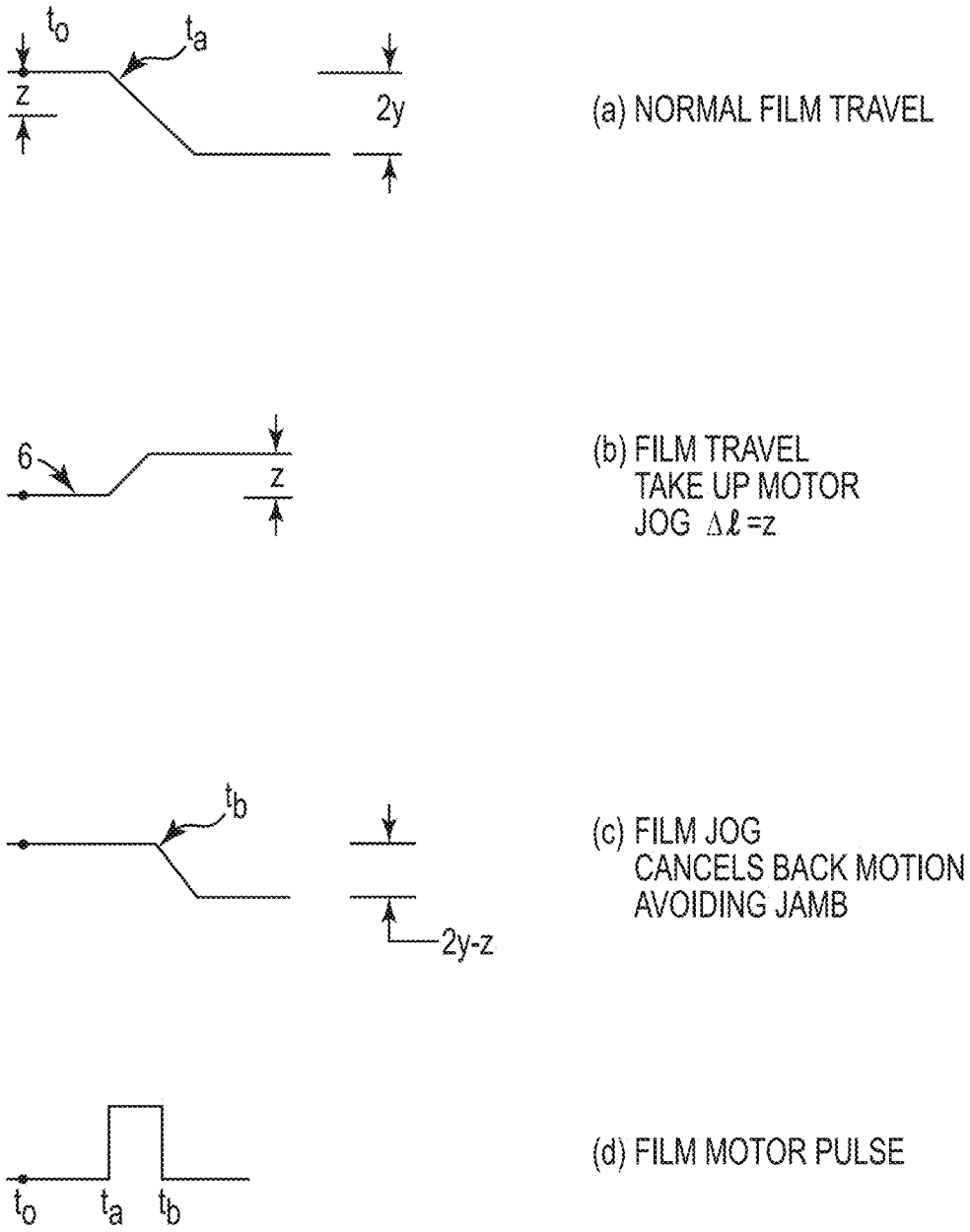
FIG. 10 illustrates an embodiment of the motion of the film after sealing.

FIG. 10, shows the motion of the films as well as the take-up motor pulse. At time "$t_0$", the seal is complete and the system starts its return. At time "$t_a$", the film starts to move backward. At the same time the take-up motor moves take-up film (6) a distance "z". Thus, the trailing film (6) remains stationary for the duration of the pulse "$t_b$", after which the tensioner will retract 2y-z of film.

FIG. 8 also shows the basic components of the seal and trim mechanism. Film 6 is driven by take-up reel 2 stopping when the film sensor 8 detects an index mark. Up to this point, film 6 and film 7 are coupled and move in tandem. Guide rollers 10 align the film so that it is parallel to the heater block 12. This is the home position of the press where there is ample clearance Y for the turntable to rotate without obstructions.

Once the take-up reel is stopped, the heater block will force the film downward until held in place by compressive action of O-rings 9. From the geometry, it can be seen that film 7 will move downward 2Y, drawing from the film tensioner 3 a like amount. At this point the film is fixed and the seal and trim part of the operation can start.

FIG. 9*a* shows the trim after seal operation. Once trimmed, the heater block reverses direction and starts up as shown in FIG. 9*b*. Once the film is no longer in contact with the rubber, the film tension causes the film to move back. If there is some momentary sticking of the pods to the heater block, the simultaneous operations cause the film to lodge beneath the pod lid as shown in FIG. 9*c* and jamb the operation.

FIG. 10*a* shows the film 7 moving to recover the 2Y that was played out. In FIG. 10*b*, the take up motor jogs the film 6. So that the two motions cancel, rendering the film stationary during the critical time. In the figure, film 6 is shown to move z units. In FIG. 10*c*, film 7 is shown to move amount 2y-z units. FIG. 10*d*, shows the take-up motor pulse. The timing is experimentally determined and once determined, can be fixed thereafter.

Accommodating Large Food Product Amounts

In embodiments, the packaging system uses the Keurig Pod®. The overall physical dimensions are defined and in most cases limit the amount of food product that can be packaged in a pod, typically 8-9 grams.

In cases where it is desirable to package larger amounts of food product (e.g. coffee), the amount can usually (and safely) be increased to 10-12 grams. Beyond 12 grams, however, the loosely packed food product will spill over the pod's lip and compromise the seal.

In commercial packaging systems, a station is added to compact the food product (e.g. coffee). This will increase the machine size, add more cost, and will likely require pneumatic power. Adding a half step after the fill is trouble prone for several reasons: insufficient room, difficult reach for single operator, and introduction of a safety hazard (FIG. 11).

In one embodiment, the rotatable platform is backed a half step after the fill (toward the load and unload station) where there is ample room and easy access by an operator (FIG. 12). In this position, the food product can be tamped and any food product that may have fallen on the pod's lip brushed away before resuming the operation. In embodiments, 13-16 grams may be safely packed at a cost of doubling pod transport time.

FIG. 11*a* shows the scant space to respond to overfilled pods exiting the filling station. FIG. 11*a* shows only 40 degrees between the Fill and Press. In contrast there is ample space surrounding the Load/Unload station, about 165 degrees.

FIG. 11*b* shows the pattern of the table in 2-step mode. Once started, 180 degrees forward, 60 degrees back, 180 degrees forward, 60 degrees back etc.

Improved Rotatable Platform Control

In critical motion control situations, sophisticated (and expensive) feedback control systems are employed. While the rotatable platform has such critical requirements, the use of feedback systems is cost prohibitive and thus one must use less expensive open loop systems in a creative fashion so as to achieve the same accuracy.

The open loop system used to control the rotatable platform is a stepper motor that uses many steps to traverse the necessary 120 degree span. For example, 72,000 micro steps may be required to traverse such a span. Due to variable frictional forces, the rotatable platform motion may not always respond to a digital pulse. Thus, pulses get "lost" resulting in motion that is only approximately correct.

FIG. 12 shows the underside of the rotatable platform (g4) and three pins (13) that are accurately positioned to be 120 degree apart. A proximity sensor (14) signals the passing of the pin. The position of the sensor is subject to manufacturing tolerances. Moreover, access (for adjustment) would be difficult because the sensor is beneath the rotatable platform and therefore not accessible. Because the pin passing through the gate is repeatable, once adjusted no further adjustments will be required.

For the first 118 degree, the rotatable platform is traversed in high speed mode. Because of "lost pulses" the rotatable platform position might really be 117 degrees. Referring to FIG. 12*b*, the mode is a slower (and more accurate) mode in order to creep up on the pin. Once the pin is sensed, an experimentally determined offset is added (in this case 350 pulses) to arrive at final stopping point. A loss of several pulses (out of 350) during this final step is virtually of no consequence. Thus, in one embodiment an accurate rotatable platform position is achieved that is well aligned to accept the seal of the press.

Various modifications and additions can be made to the exemplary embodiments discussed without departing from the scope of the present disclosure. For example, while the embodiments described above refer to particular features, the scope of this disclosure also includes embodiments having different combinations of features and embodiments that do not include all of the described features. Accordingly, the scope of the present disclosure in intended to embrace all such alternatives, modifications, and variations as fall within the scope of the claims, together with all equivalents thereof.

What is claimed is:

1. An apparatus for filling single-serve pods, comprising:

a base supporting a rotatable platform comprising three groups of pod holders located at three stations displaced equidistant in 120° sectors around the rotatable platform, wherein a group of pod holders is configured to hold a corresponding plurality of pods to be filled at a single time;

a filler mounted on the base and adjacent to the rotatable platform, the filler comprising a container filled with a ground food product and multiple augers capable of filling the plurality of pods held by the group of pod holders with the ground food product, wherein the multiple augers comprise multiple spouts to deliver the ground food product to the plurality of pods held by the group of pod holders;

a sealer mounted on the base 120° apart from the filler and adjacent to the rotatable platform, the sealer comprising a film winder, a movable heater block assembly fitted with a linear actuator, and a trimmer, wherein the heater block assembly is aligned with a top of the pods to apply and seal a heat sealable film to a top of the plurality of pods, and wherein the trimmer cuts the heat sealable film sealed to the plurality of pods, and a controller configured to:

a) selectively rotate the rotatable platform to position the group of pod holders based on the position of the rotatable platform, and to selectively position two of the three stations relative to the filler and the sealer, b) fill the ground food product into the plurality of pods using the filler, and c) seal and trim the sealed film tops of the plurality of pods after filling.

2. The apparatus of claim 1, wherein the plurality of pod holders include a snap ring comprising a gimbal arrangement that permits vertical, twisting, and turning motion of the plurality of pods.

3. The apparatus of claim 1, further comprising a layer of rubber positioned beneath the pod holders and configured to provide compliance between the pod holders and the heater block assembly.

4. The apparatus of claim 1, wherein the plurality of pods are configured to be packaged with 13-16 grams of ground food product.

5. The apparatus of claim 1, wherein the heat sealable film is held static to prevent jamming of heat sealable film.

6. The apparatus claim 1, wherein the rotatable platform is selectively positioned and aligned using the controller to accept the heat sealable film of the sealer.

7. The apparatus of claim 6, wherein the rotatable platform position is checked and adjusted using the controller by comparison with signals sensed by a sensor operatively coupled to the controller.

8. The apparatus of claim 1, wherein the group of pod holders comprises four pod holders.

9. The apparatus of claim 8, wherein the group of pod holders are arranged in a two-by-two grid.

10. A method for filing a plurality of single-use pods, the method comprising:

rotating a platform from a load station to a filling station, the platform comprising three groups of pod holders each group of pod holders is configured to hold a corresponding plurality of pods to be filled at a single time, the groups of pod holders located at three stations, including at least a) the filling station and b) a sealing and trimming station displaced equidistant in 120° sectors around the platform;

filling a plurality of empty pods held by a group of corresponding pod holders with a ground food product from multiple augers and multiple spouts that are adapted to deliver the ground food product into the plurality of empty pods;

rotating the filled plurality of pods and corresponding group of pod holders from the filling station 120° to the sealing and trimming station;

sealing the filled pods with a heat sealable film by applying and sealing the heat sealable film to filled pods using a sealer of the sealing and trimming station; and cutting the heat sealable film using a trimmer of the sealing and trimming station;

wherein the rotating, the filling, and the sealing steps are controlled by a controller operatively coupled to the platform, the filling station, and the sealing and trimming station, the controller comprising software controlling and directing movement and operations of the platform, the filler, the sealer, and the trimmer.

11. An apparatus for filling single-serve pods, comprising:

a base supporting a rotatable platform comprising three groups of pod holders located at three stations displaced equidistant in 120° sectors around the rotatable platform, wherein a group of pod holders is configured to hold a corresponding plurality of pods to be filled at a single time;

a filler mounted on the base and adjacent to the rotatable platform, the filler comprising a container filled with a ground food product and multiple augers capable of filling the plurality of pods held by the group of pod holders with the ground food product, wherein the multiple augers comprise multiple spouts to deliver the ground food product to the plurality of pods held by the group of pod holders;

a sealer mounted on the base 120° apart from the filler and adjacent to the rotatable platform, the sealer comprising a film winder, a movable heater block assembly fitted with a linear actuator, and a trimmer, wherein the heater block assembly is aligned with a top of the pods to apply and seal a heat sealable film to a top of the plurality of pods, and wherein the trimmer cuts the heat sealable film sealed to the plurality of pods, and a controller configured to:

a) selectively rotate the rotatable platform to position the group of pod holders based on the position of the rotatable platform, and to selectively position two of the three stations relative to the filler and the sealer, b) the ground food product into the plurality of pods using the filler, and c) seal and trim the sealed film tops of the plurality of pods after filling;

wherein the rotatable platform is backed a half step after the fill toward a load and unload station to tamp the food product in the pod or remove fallen food product.

12. The apparatus of claim 11, wherein the rotatable platform is moved 180 degrees forward, 60 degrees back, 180 degrees forward, and 60 degrees back.

13. The apparatus of claim 11, wherein rotatable platform being backed the half step corresponds to the rotatable platform being backed by 60 degrees.

* * * * *